US006633269B2

(12) United States Patent
Huang et al.

(10) Patent No.: US 6,633,269 B2
(45) Date of Patent: Oct. 14, 2003

(54) DRIVING METHOD FOR PLASMA DISPLAY PANELS

(75) Inventors: Jih-Fon Huang, Chupei (TW); Chih-Lung Lin, Hsinying (TW); Yu-Ting Chien, Yungho (TW); Shin-Tai Lo, Miao-Li (TW)

(73) Assignee: AU Optronics Corp., Hsin-Chu (TW)

( * ) Notice: Subject to any disclaimer, the term of this patent is extended or adjusted under 35 U.S.C. 154(b) by 253 days.

(21) Appl. No.: 09/800,578

(22) Filed: Mar. 8, 2001

(65) Prior Publication Data

US 2002/0057231 A1 May 16, 2002

(30) Foreign Application Priority Data

Nov. 10, 2000 (TW) ..... 89123783 A

(51) Int. Cl.[7] ..... G09G 3/28

(52) U.S. Cl. ..... 345/63; 345/38; 345/60; 345/66

(58) Field of Search ..... 345/38, 60, 66, 345/63

(56) References Cited

U.S. PATENT DOCUMENTS 5,250,936 A * 10/1993 Warren et al. ..... 345/60
5,852,347 A * 12/1998 Marcotte ..... 315/169.4

* cited by examiner

*Primary Examiner*—Joseph Mancuso
*Assistant Examiner*—Ming-Hun Liu
(74) *Attorney, Agent, or Firm*—Winston Hsu

(57) ABSTRACT

A driving method during the reset period of a plasma display, which includes a display panel with a plurality of display units for sealing the inert gas. Each display unit forms an equivalent capacitor and includes a first electrode, a second electrode, and a driving circuit that exerts voltage pulses to the display units to form wall charges on the surfaces of the two electrodes or to reduce the wall charges that have been formed. The method involves applying a first soft erase pulse on the first electrodes of the plurality of display units to reduce the wall charges of the plurality of the display units followed by applying a soft priming pulse on the second electrodes of the plurality of display units to re-generate the wall charges of the plurality of display units. Then, a second soft erase pulse is exerted on the first electrodes of the plurality of the display units to reduce the wall charges of the plurality of the display units and make the voltages of the remaining wall charges of the plurality of the display units relatively the same.

11 Claims, 5 Drawing Sheets

DRIVING METHOD FOR PLASMA DISPLAY PANELS

FIELD OF INVENTION

The present invention relates to a driving method for a plasma display panel (PDP), and more particularly, to a method of providing erase pulses with different voltage values so as to make the voltages of the remaining wall charges of the plurality of the display units during the reset period relatively the same, and to ensure that the plurality of display units are driven properly during the following address period and sustain period so that the probability of the erroneous discharging is decreased.

DESCRIPTION OF THE PRIOR ART

Recently, plasma display panels (PDP) are becoming the most commonly used large-sized displays due to their large, slender size and their irradiative characteristic. A PDP includes a plurality of display units positioned within a matrix. Each display unit includes one sustain electrode (The X electrode), one scanning electrode (the Y electrode), and one data electrode (the A electrode), for sealing an inert gas and each unit is driven with a fixed driving sequence by a driving circuit to allow the inert gas to repeatedly emit light. A proper driving sequence can be divided into the following periods: a) reset period, b) address period, and c) sustain period. A display panel of the PDP can equivalently be regarded as a capacitor. By charging the capacitor and applying the two ends (The X electrodes and the Y electrodes) of the capacitor with alternating current (AC) pulses, the gas atoms within the display units are able to repeatedly emit ultraviolet light. Then, the ultraviolet light of a specific wavelength is absorbed by the phosphors within the display unit to emit visible light.

It is necessary to provide the moderate driving waveforms and voltages during the sustain period of the driving sequence to allow the display units to emit visible light. Different driving voltages affect the operation of the display units, whereby the display units can be properly driven within the specific range of driving voltages. The PDP should be operated under an adequate sustain operating voltage range, whereby the larger the adequate sustain operating voltage range, the more efficient the plasma display panel.

Please refer to FIG. 1, FIG. 1 is a timing diagram of the driving sequence for a plasma display panel of a prior art. The driving circuit of the prior art applies a first soft erase pulse 62, with a time interval of 100 $\mu$s, to the Y electrodes 18 of all the display units to reduce the remaining wall charges of the last sustain period. Then, the driving circuit applies a soft priming pulse 64 on all the X electrodes to re-generate the wall charges, followed by the a second soft erase pulse 66, with a time interval of 100 $\mu$s, on all the Y electrodes 18 to again reduce the wall charges. In order to cope with the image information during the following sustain period, the wall charges generated by the address discharges that caused by the data electrodes (the A electrodes) and the scanning electrodes (the Y electrodes) need to be correctly inputted into the assigned display units. Then, applying repeated sustain pulses 68 on both the X electrodes 16 and the Y electrodes 18 allow the inert gas to emit light and images are displayed.

Since the first soft erase pulse 62 and the second soft erase pulse 66 are generated by the same driving circuit, both their voltages and their time constant of the rising slopes are equal. Also, the voltage of the sustain pulses 68 is equal to the peak voltage of the first soft erase pulse 62 and that of the second soft erase pulse 66, represented as $V_s$. However, the differences between the display units would lead to he images showed on the plasma panel flickeringly. It is the reason that the inability to make the voltages of the remaining wall charges in different display units relatively the same after the reset period.

It is an object of the present invention to provide a new driving method, which is simple and efficient to drive all display units, and to decrease the differences of the wall voltages in different display units so as that the remaining wall charges relatively the same after the reset period to solve the flickering problem of the PDP.

In accordance with the present invention, a driving method during the reset period of a PDP involves applying a first soft erase pulse on the first electrodes of the plurality of display units to reduce the wall charges of the plurality of the display units. Next, a soft priming pulse is applied on the second electrodes of the plurality of display units to reproduce the wall charges of the plurality of display units. Finally, a second soft erase pulse is applied on the first electrodes of the plurality of the display units to clear the wall charges of the plurality of the display units and decrease the differences of the wall voltages in different display units so as that of the remaining wall charges of the plurality of the display units relatively the same, due to the voltage of the second soft erase pulse being greater than that of the first soft erase pulse.

It is an advantage of the present invention that it provides different voltage levels for the first soft erase pulse and the second soft erase pulse to make the voltage levels of the remaining wall charges relatively the same during the reset period and reduce the flickering in the PDP.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 1:
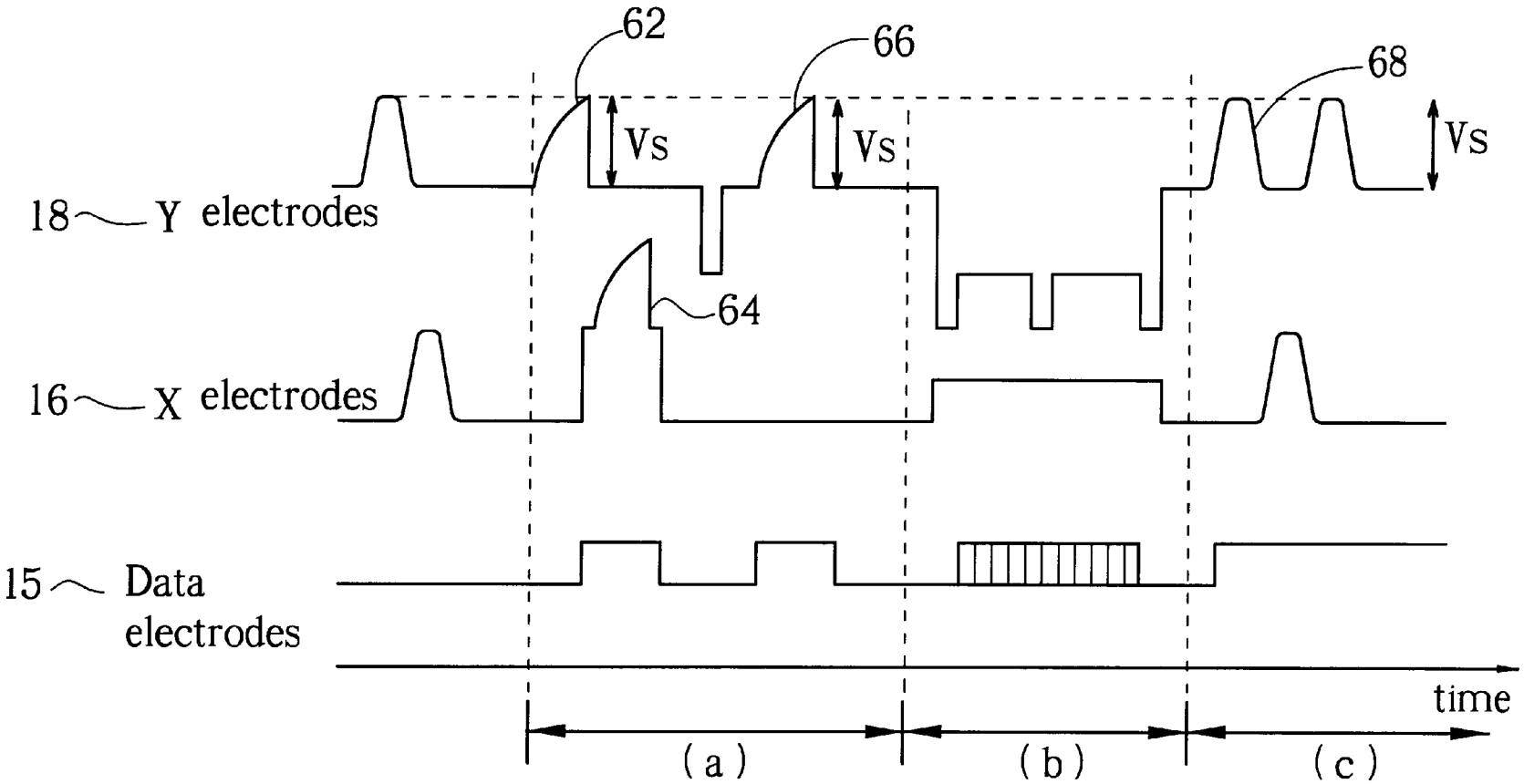
Fig. 1 Prior art
FIG. 1 is a timing diagram for a plasma display of a prior art.
Figure 2:
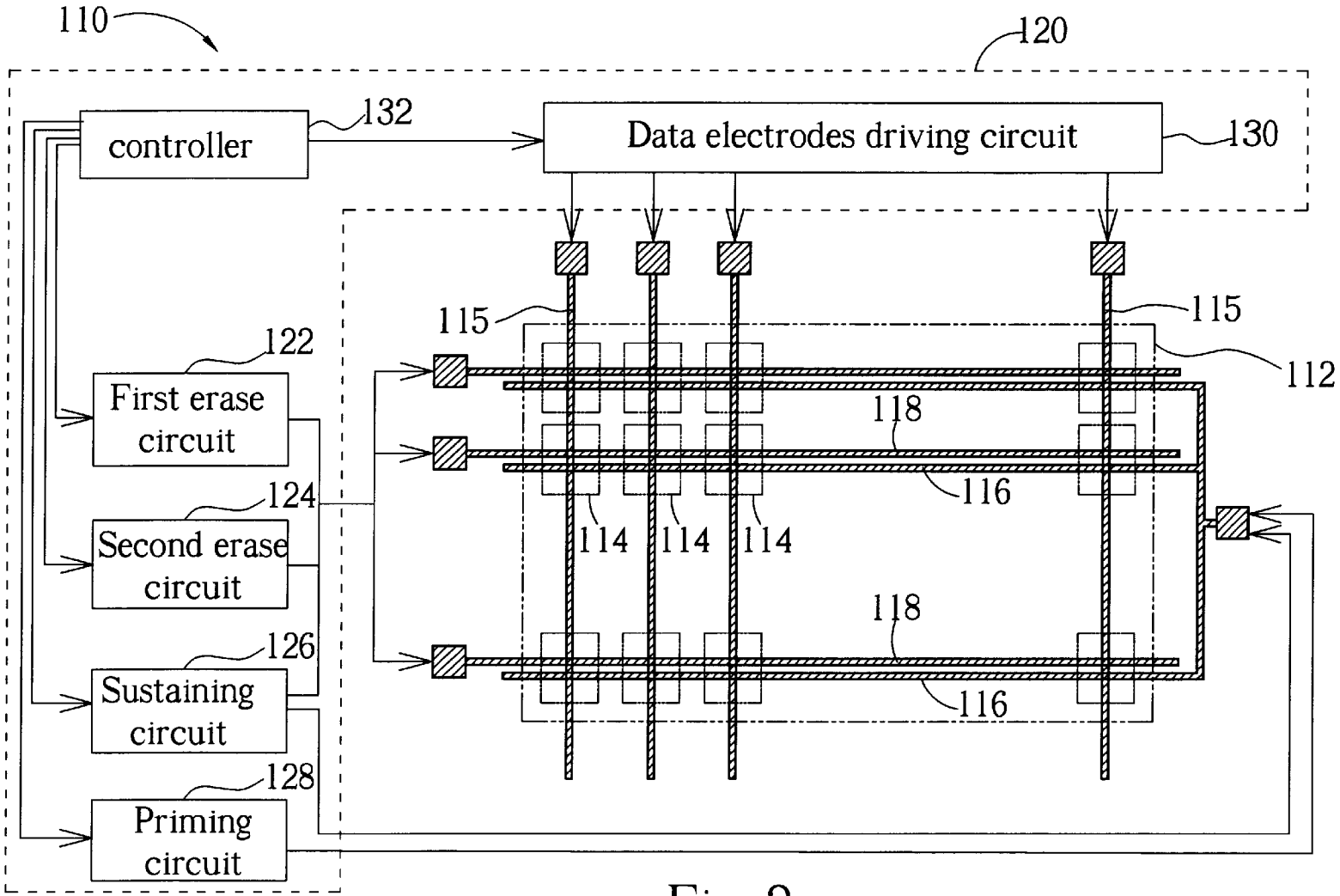
FIG. 2 is a schematic diagram of the present invention display device.

Please refer to FIG. 2, FIG. 2 is a schematic diagram of the present invention of plasma display device 110. The plasma display device 110 includes a display panel 112 for displaying images, and a driving circuit 120 for driving and controlling the display status of the images on the display panel 112. The display panel 112 includes a plurality of display units 114 sealing with inert gases, and a set of the X electrodes 116, the Y electrodes 118 and data electrodes 115. The driving circuit 120 includes a first erase circuit 122, a second erase circuit 124, a sustaining circuit 126, a priming circuit 128, a data electrodes driving circuit 130 of data electrodes and a controller 132. The first erase circuit 122 and the second erase circuit 124 are used to reduce the wall charges of the display units 114 during the reset period. According to the image data, the driving circuit 130 of data electrodes applies data pulses to the data electrodes 115 during the address period to input the image information into the predetermined addresses. The sustaining circuit 126 is used to drive the X electrodes 116 and the Y electrodes 118, to ignite the inert gas within the display units 114 continually, and to allow the display units 114 to continually emit visible light. The controller 132 is used to control the operations of the first erase circuit 122, the second erase circuit 124, the sustaining circuit 126, the priming circuit 128, and the driving circuit 130 of data electrodes. The X electrodes 116 and the Y electrodes 118 are positioned in parallel within the display units 114, the display units 114 further include data electrodes 115 within themselves, and the data electrodes 115 are vertical to the X electrodes 116 and the Y electrodes 118.

Figure 3:
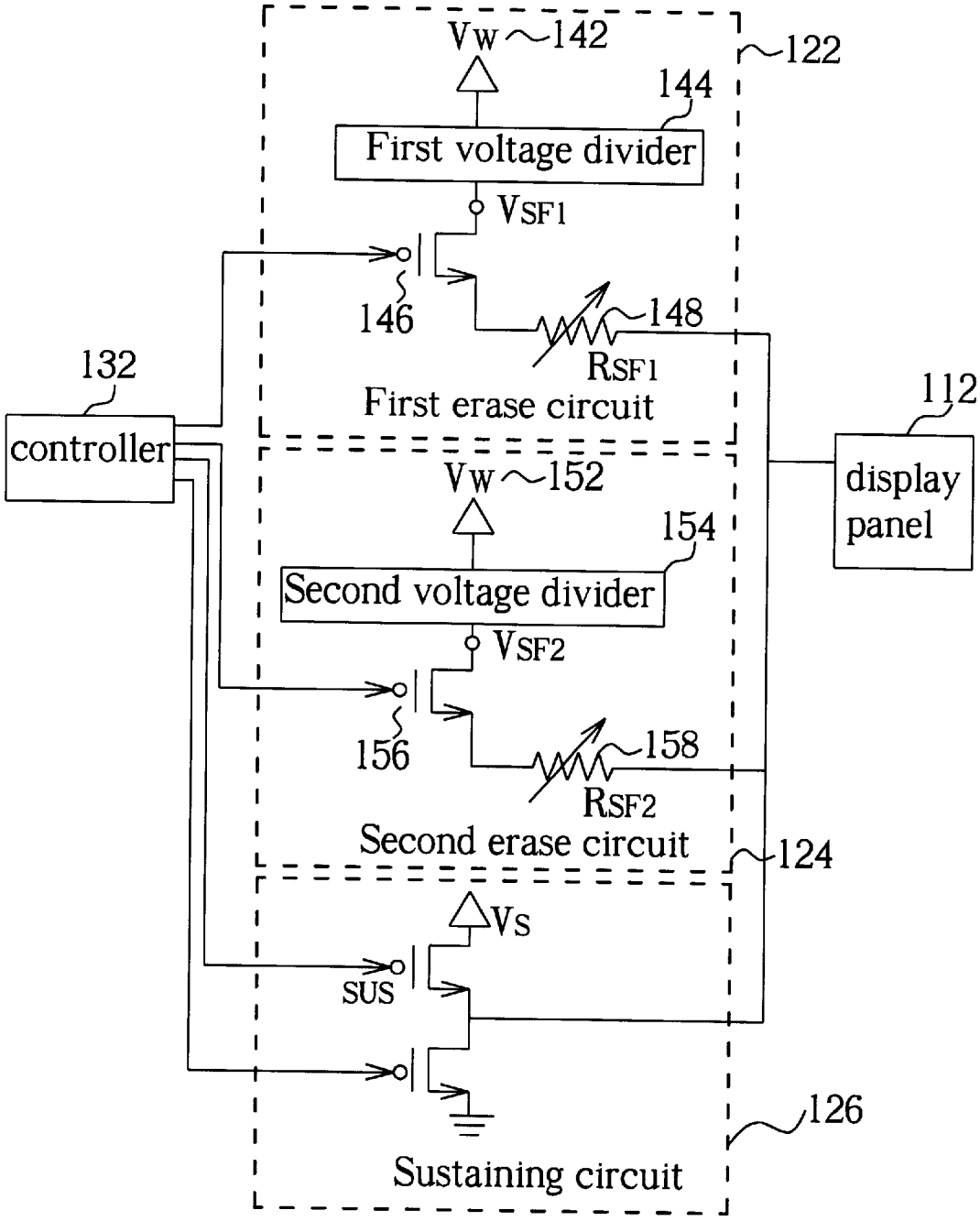
FIG. 3 is a schematic diagram of the first erase circuit and the second erase circuit according to the present invention.

Please refer to FIG. 3, FIG. 3 is a schematic diagram of the first erase circuit 122 and the second erase circuit 124 according to the present invention. The first erase circuit 122 includes a voltage source 142, a first voltage divider 144, a switch 146 and a resistor 148, the resistor 148 can be a fixed variable resistor. The voltage source 142 of the first erase circuit 122 can provide the required voltage for driving the display panel 112. For example, if the voltage source 142 of the first erase circuit 122 applies an voltage of 190V to the first voltage divider 144, and then the first voltage divider 144 divides the applied 190V voltage appropriately to generate an voltage Vsf1 of 170 volts. The controller 132 can control the switch 146 in the status of either "ON" or "OFF". The resistor 148 connects the equivalent capacitor of display units 114 in series to form the first RC circuit. When the controller 132 turns on the switch 146, the first voltage divider 144 deliver the electric current from the voltage source 142 to the display panel 112 via the resistor 148. In other words, the voltage source 142 can transfer certain energy to the display panel 112 to charge the first RC circuit to generate the first soft erase pulse applied to the display units 114. When the controller 132 turns off the switch 146, the electric current from the first voltage divider 144 is blocked and the voltage source 142 is unable to deliver to the display panel 112.

Similarly, the second erase circuit 124 includes a voltage source 152, a second voltage divider 154, a switch 156 and a resistor 158, the resistor 158 can be a fixed or variable resistor. The voltage source 152 of the second erase circuit 124 can provide the required voltage for the display panel 112. For example, if the voltage source 152 of the second erase circuit 124 applies an voltage of 190V to the second voltage divider 154, and then the second voltage divider 154 divides the applied 190V voltage appropriately to generate the voltage Vsf2 of 180 volts. The controller 132 controls the switch 156 in the status of either "ON" or "OFF". The resistor 158 connects the equivalent capacitor of display units 114 in series to form the second RC circuit. When the controller 132 turns on the switch 156, the second voltage divider 154 delivers the electric current from the voltage source 152 to the display panel 112 via the resistor 158. In other words, the voltage source 152 can transfer certain energy to the display panel 112 to charge the second RC circuit to generate the second soft erase pulse applied onto the display units 114. When the controller 132 turns off the switch 156, the electric current from the second voltage divider 154 is blocked and is unable to be transfer further energy to the display panel 112. To reduce the hardware complexity, the voltage source 142 of the first erase circuit 122 and the voltage source 152 of the second erase circuit 124 can be the same.

Figure 4:
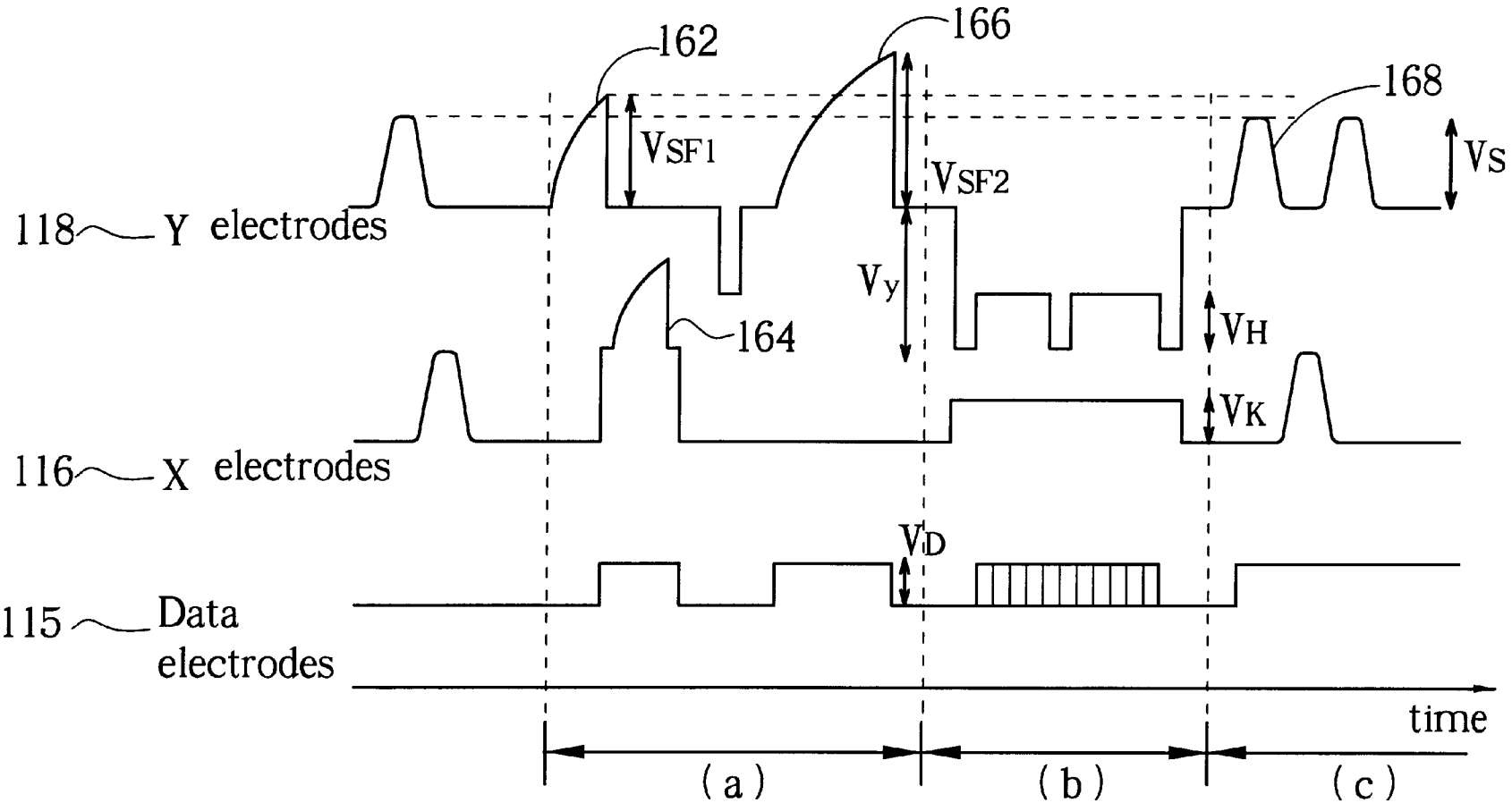
FIG. 4 is a timing diagram of a plasma display device according to the present invention.

Please refer to FIG. 4, FIG. 4 is a timing diagram of the driving sequence of the plasma display device 110 according to the present invention. During the reset period, the controller 132 turns on the switch 146 and the first erase circuit 122 applies a first soft erase pulse 162, with a time interval of 160 $\mu$s on the Y electrodes 118 of all the display units 114 to reduce the remained wall charges generated during the previous sustain period. Then, the priming circuit 128 applies a priming pulse 164 on the X electrodes 116 of all display units 114 to re-generate the wall charges within each display units 114. Next, the second erase circuit 124 applies a second erase pulse 166 with a time interval of 190 $\mu$s on the Y electrodes 118 of all the display units 114 to reduce the wall charges again within each display units 114.

During the addressing period, the driving circuit 130 of data electrodes applies data voltage pulses to the data electrodes 115 to correctly input the image data into the display units 114 selected by simultaneously activating both X electrodes 116 and Y electrodes 118.

During the sustaining period, the sustaining circuit 126 repeatedly generates sustain pulses 168 on both the X electrodes 116 and the Y electrodes 118 to ignite the inert gas within the display units and the visible light is emitted to repeatedly emit light to display images.

Repeating the reset-addressing-sustaining cycle as discussed above in different sub-fields, the display panel can be driven by different number of sustain pulses so that a user can see the image shown on the plasma display device 110.

To improve the uniformity of all display units 114, i.e. to make the wall charge generated from previous sustaining period be more evenly distributed during next reset period, the corresponding voltages are preferably arranged as follows: (1) the voltage Vsf1 of the first soft erase pulse 162 and the voltage Vsf2 of the second soft erase pulse 168 both are greater than the voltage Vs of the sustaining pulse 168, and (2) the voltage Vsf2 of the second soft erase pulse 168 is greater than that of the first soft erase pulse 162.

Through above arrangement, the voltage differences among different display units 114 generated from unevenly distribution of the remaining wall charges are dramatically reduced.

One advantage of the present invention is to decrease the probability of mis-discharging and abnormal displaying. Because of the variation of the process, it is difficult to produce a plasma display panel with the similar optical properties among different display units 114, so as it is difficult to make the remaining wall charges uniformly distributed within different display units 114.

In the prior art, the voltage difference among different display units 114 generated by the remaining wall charges are not efficiently reduced during the reset period, so it easily leads to the occurrence of flickering of the PDP during the following addressing period and sustaining period when displaying low gray level pixels or during warm-up period.

The method of the driving circuit 120 of the plasma display device 110 according to the present invention comprises applying the first soft erase pulse 162, the priming pulse 164, and the second soft erase pulse 166, to reduce, re-generate, and reduce the wall charges again within the display units 114 respectively. The wall charges can be reduced to nearly the same degree within most display units 114 during the reset period due to the higher voltage level and longer duty time of the second soft erase pulse 166 than that of the first soft erase pulse 162. Thus, the voltages generated by the wall charges within the display units are relatively the same after the reset period, and it does decrease the probability of mis-discharging and abnormal displaying when the same addressing pulse and sustaining pulse are applied on the display units 114.

Figure 5:
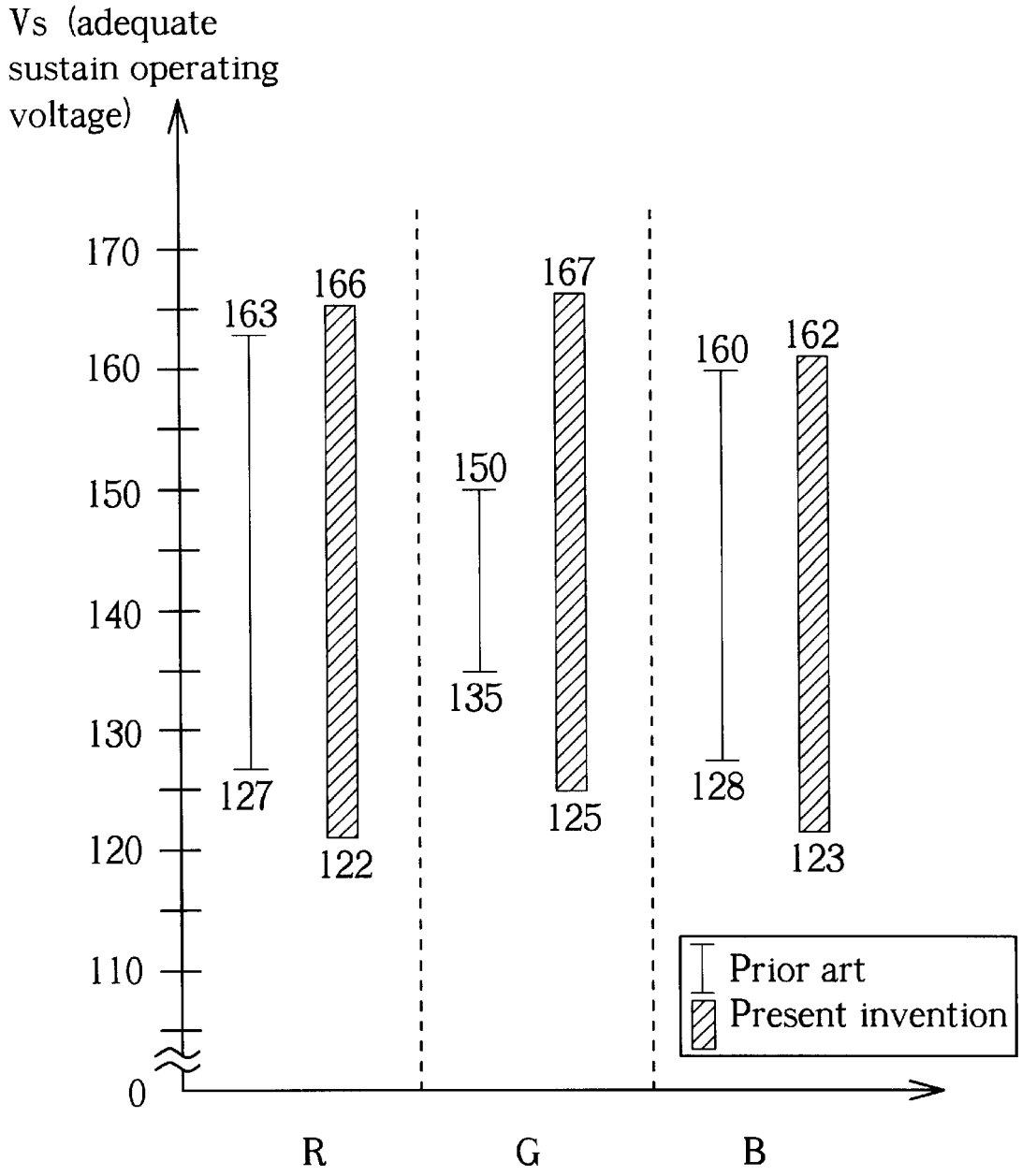
FIG. 5 is a schematic diagram of the comparison in the margin of the adequate sustain operating voltage between the present invention and the prior art.

Another advantage of the present invention is an increase the margin of the operating voltage. Please refer to FIG. 5, FIG. 5 is a schematic diagram of the comparison in the margin of the adequate sustain operating voltage between the present invention and the prior art. As shown in FIG. 5, the parameters are set so that Vw equals 190 volts, Vk equals 55 volts, Vh equals 82 volts, and Vy equals 164 volts. The margin of the adequate sustain operating voltage of the sustaining pulses Vs of the prior art and the present invention are represented as line segments and slant-line wickers respectively. The results show that the margin of the adequate sustain operating voltage of the present invention is greater than that of the prior art, and therefore the present invention is more easier than the prior art in designing the driving pulses.

Another advantage of the present invention is to prevent the shortcoming of temperature issue of the resistor of the prior art from temperature becoming too high. The driving circuit 120 of the plasma display device 110 of the present invention includes both the independent first erase circuit 122 and the independent second erase circuit 124, controlled by the controller 132 respectively, which apply the first soft erase pulse 162 and the second soft erase pulse 166 on the display units 114 respectively. The result shows that current passes through the resistors 148 and 158 of the present invention being half that of the prior art during a time interval, therefore the present can prevent the resistor from burnout.

Another advantage of the present invention is to increase the contrast of the display panel. Since both the resistors 148 and 158 of the driving circuit 120 can be adjusted to change the time constant of the RC circuit, the wall charges can be prevented from being re-generated to prevent light from being emitted due to the steep voltage drop of display units caused by the use of an improper time constant. In other words, if the light emitted by display units during the reset period is relatively weak, a user will identify the light emitted by the display units during the sustain period as bright and increase the contrast of the display panel.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A reset period driving method for a plasma display device, said plasma display device comprising a display panel with a plurality of display units formed thereon, each display unit comprising a first electrode and a second electrode, and a driving circuit applying voltage pulses on the first electrodes and the second electrodes to generate wall charges within the display units or to reduce the wall charges remaining within the display units, the method comprising:

applying a first soft erase pulse on the first electrodes of the plurality of display units to reduce the wall charges of the plurality of the display units; applying a soft priming pulse on the second electrodes of the plurality of display units to re-generate the wall charges within the plurality of display units; and applying a second soft erase pulse on the first electrodes of the plurality of the display units to reduce the wall charges of the plurality of the display units, and the voltage of the second soft erase pulse being greater than that of the first soft erase pulse.

2. The driving method of claim 1 wherein the driving circuit applies a plurality of sustaining pulses with voltages less than that of the first and the second soft erase pulses, to drive an inert gas sealed within the display unit back and forth between the two electrodes so as to allow the display units to continually emit light.

3. The driving method of claim 1 wherein the first electrode and the second electrode are positioned in parallel within the display units, with the display units further comprising a third electrode positioned within the display units, the third electrode vertical to the first and the second electrode.

4. The driving method of claim 3 wherein the driving circuit further comprises a third driving unit to drive the third electrode of the display units.

5. A driving circuit during the reset period for a plasma display, which comprises a display panel with a plurality of display units for sealing the inert gas, whereby each unit forms an equivalent capacitor and comprises a first electrode and a second electrode, that functions to exert voltage pulses to the display units to form wall charges on the surfaces of the two electrodes or to reduce the wall charges that have been formed, the driving circuit comprising:

a first erase circuit applying a first soft erase pulse on the first electrodes of the plurality of display units to reduce the wall charges of the plurality of the display units;

a priming circuit applying a soft priming pulse on the second electrodes of the plurality of display units to re-generate the wall charges of the plurality of display units; and a second erase circuit applying a second soft erase pulse on the first electrodes of the plurality of the display units to reduce the wall charges of the plurality of the display units;

wherein the voltages of the remaining wall charges of the plurality of the display units are relatively the same, due to the voltage of the second soft erase pulse being greater than that of the first soft erase pulse.

6. The driving circuit of claim 5 further comprises a sustaining circuit to exert a plurality of sustained pulses, with voltages less than that of the first and the second soft erase pulse, on the two electrodes during the sustain period and to drive the inert gas back and forth between the two electrodes so as to allow the display units to continually emit light.

7. The driving circuit of claim 6 further comprises a controller to control the operations of the first erase circuit, the priming circuit, the second erase circuit, and the sustain circuit.

8. The driving circuit of claim 7 wherein the first erase circuit comprises a first voltage divider, a switch, and a resistor, with the resistor of the first erase circuit and the equivalent capacitor of the display units forming a RC circuit to produce the first soft erase pulse when the switch is turned on, and the first voltage divider charging the RC circuit.

9. The driving circuit of claim 7 wherein the second erase circuit comprises a second voltage divider, a switch, and a resistor, with the resistor of the second erase circuit and the equivalent capacitor of the display units forming a RC circuit to produce the second soft erase pulse when the switch is turned on, and the second voltage divider charging the RC circuit.

10. The driving circuit of claim 5 wherein the first electrode and the second electrode are positioned in parallel within the display units, with the display units further comprising a third electrode positioned within the display units, the third electrode was vertical to the first and the second electrode.

11. The driving circuit of claim 10 further comprises a data electrode driving circuit to drive the third electrode of the display unite.

* * * * *